US008525628B2

(12) United States Patent
Weber et al.

(10) Patent No.: US 8,525,628 B2
(45) Date of Patent: Sep. 3, 2013

(54) HOUSING FOR AN ELECTRIC MACHINE

(75) Inventors: Benjamin Weber, Winterberg (DE); Marcos Bockholt, Paderborn (DE); Michael Luckey, Marsberg (DE); Wolfgang Mönig, Brilon (DE); Jens Tepper, Brilon (DE)

(73) Assignee: ABB Technology AG, Zurich (CH)

( * ) Notice: Subject to any disclaimer, the term of this patent is extended or adjusted under 35 U.S.C. 154(b) by 24 days.

(21) Appl. No.: 12/987,603

(22) Filed: Jan. 10, 2011

(65) Prior Publication Data

US 2011/0175695 A1 Jul. 21, 2011

(30) Foreign Application Priority Data

Jan. 16, 2010 (EP) ..... 10000374

(51) Int. Cl.
*H01F 27/08* (2006.01)

(52) U.S. Cl.
USPC ..... 336/55

(58) Field of Classification Search
USPC ..... 336/55–67
See application file for complete search history.

(56) References Cited

U.S. PATENT DOCUMENTS

| | | | | |
|---|---|---|---|---|
| 2,654,583 | A * | 10/1953 | Treanor | 165/104.34 |
| 2,990,443 | A * | 6/1961 | Camilli | 174/15.1 |
| 3,137,829 | A | 6/1964 | Dillow et al. | |
| 3,551,863 | A | 12/1970 | Marton | |
| 3,659,239 | A * | 4/1972 | Marton | 336/57 |
| 4,032,873 | A | 6/1977 | Jallouk | |
| 4,512,387 | A * | 4/1985 | Rodriguez et al. | 165/292 |
| 4,956,626 | A * | 9/1990 | Hoppe et al. | 336/60 |
| 2007/0188282 | A1 * | 8/2007 | Folts et al. | 336/55 |
| 2009/0056916 | A1 | 3/2009 | Yesin et al. | |

FOREIGN PATENT DOCUMENTS

DE 198 12 243 A1 9/1999

OTHER PUBLICATIONS

European Search Report for EP 10000374 dated Jul. 17, 2010.

* cited by examiner

*Primary Examiner* — Tuyen Nguyen
(74) *Attorney, Agent, or Firm* — Buchanan Ingersoll & Rooney PC

(57) ABSTRACT

The disclosure relates to a housing for an electric machine, for example, an electric power transformer, such as a dry-type transformer, with cooling channels being provided within the housing for a cooling medium. The electric machine and a cooling system can be arranged in the housing, with vertically arranged first and second channels for the cooling medium being provided. The medium can flow around the electric machine, with the housing accommodating the electric machine and the cooling system substantially forming a hermetic encapsulation.

16 Claims, 2 Drawing Sheets

HOUSING FOR AN ELECTRIC MACHINE

RELATED APPLICATIONS

This application claims priority under 35 U.S.C. §119 to European Patent Application No. 10000374.8 filed in Europe on Jan. 16, 2010, the entire content of which is hereby incorporated by reference in its entirety.

FIELD

The disclosure relates to a housing for an electric machine, especially for an electric power transformer, for example, a dry-type transformer, within which cooling channels are provided through which a cooling medium flows.

BACKGROUND INFORMATION

Cooling can occur in electric machines arranged as power transformers by emitting the heat generated during the operation of a dry-type transformer directly to an ambient environment.

In electric machines, for example, high power electric machines arranged as compact power transformers, additional cooling measures can be used in addition to cooling by convection.

As a result, cooling channels for the cooling of a compact power transformer can be provided in known housing concepts. The cooling can occur by free convection, which is natural cooling.

This can be insufficient in the case of higher transformer outputs, so that the design of the housing can be adjusted or an additional separate cooling system with forced cooling can be provided.

In known cooling arrangements, which can apply to power transformers arranged as dry-type transformers, a dry-type transformer can be surrounded by a housing which provides improved cooling of the transformer by purposeful flow about its windings with cooling medium which is cooled, for example, with air-to-air coolers or air-to-water coolers.

An enclosure for a dry-type transformer is known from DE 19812243 wherein ambient air can flow all around through the enclosure, with the air cooling off and being wetted during the through-flow of an outer wettable jacket which is wetted with water either continuously or in a load-dependent fashion. The cooled and humidified air is guided in such a way that it can continuously cool the solid body surfaces heated by the high-voltage windings. The air can enter from below into the cooling channels of the individual transformer legs and can be sucked off upon exiting from the cooling channels and guided away.

This known cooling principle is based on the main components of the air, which are nitrogen and oxygen, being very bad heat carriers and virtually permeable for thermal radiation. A number of gases, especially carbon dioxide and water vapour, on the other hand, absorb radiation heat and radiate the same.

A high content of water vapor in the unsaturated state in the cooling air of a transformer can improve the thermal absorption capacity of the same. It is further known that water has a very high heat of evaporation. It is approx. 627 Wh/kg at normal pressure, so that the use of water can provide favorable heat absorption in that the air used for cooling the transformer is enriched with water. The water is allowed to evaporate as a result of the heat absorbed from the transformer and heat can be removed from the transformer.

For the regular addition of water to air a closed cooling system is desirable in order to limit the consumption of water.

On the other hand, it is desirable to newly configure and mount the respective cooling system for each transformer in the development of a transformer housing with forced cooling. The possibility of natural cooling by convection is lost in this case, which means that such transformers can then only be cooled in a forced way.

Natural cooling within and outside of the housing can be sufficient under constant ambient conditions up to a certain size of the housing in order to remove a specific amount of dissipation. In order to remove dissipation that goes beyond this or to ensure compensation for increased ambient temperature, further measures for cooling are involved.

SUMMARY

A housing for an electric machine is disclosed, including a cooling system having at least one plate-type heat exchanger for defining an inner circulation area and an outer circulation area of a cooling medium, first cooling channels provided within the housing, for conducting a flow of the cooling medium around the electric machine, and second cooling channels for conducting a flow of the cooling medium around the electric machine. The housing accommodates the electric machine and the cooling system and forms a substantially hermetic encapsulation.

BRIEF DESCRIPTION OF THE DRAWINGS

Exemplary embodiments of the disclosure and advantages of the disclosure will be explained and described in greater detail by reference to an embodiment of the disclosure as shown in the drawings, wherein.

DETAILED DESCRIPTION

Figure 1:
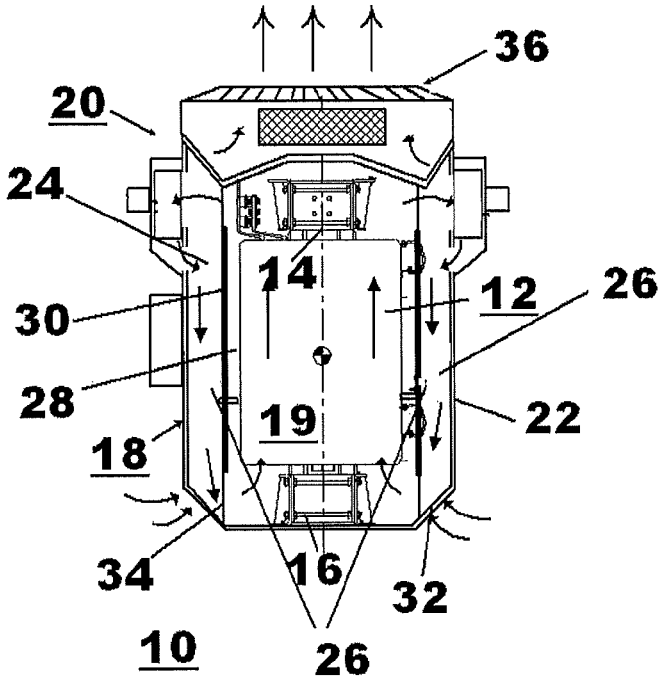
FIG. 1 shows a schematic view of an exemplary three-phase power transformer in a front sectional view.

A housing is disclosed for an electric machine which allows both natural and forced cooling of a transformer, depending on dissipation of the transformer.

According to an exemplary embodiment of the disclosure, a housing is provided in which the electric machine and the cooling system are arranged completely and which includes vertically arranged channels for a cooling medium which flow about the electric machine. The housing accommodates both the electric machine as well as the cooling system and can form a substantially hermetic encapsulation (e.g., 90% encapsulation, or lesser or greater, so as to afford sufficient encapsulation to achieve functional performance as disclosed herein).

In an exemplary embodiment, there is a possibility to integrate one or several housing modules in the side walls, which modules contain fans for improving inside circulation. In an exemplary embodiment, modules which contain external fans and improve outside circulation can be attached. Both exemplary embodiments can be considered both individually as well as in combination.

In accordance with an exemplary embodiment of disclosure, it is provided that the channels for the cooling medium can rest on the surface of the windings of the electric machine. In this case, the arrangement of the cooling channels can be provided in such a way that on the one hand the required electric insulation thickness does not fall below a specified amount, and on the other hand sufficient surface contact can be insured for the best possible heat transfer.

In an exemplary embodiment of the disclosure, the cooling medium can be gaseous. In accordance with an exemplary embodiment of the disclosure it can be provided that a medium cooling medium is used.

According to an exemplary embodiment of the disclosure, the cooling channels can be arranged for guiding the cooling medium of individual pipes which are each arranged around the respective winding of the transformer.

Instead of cooling pipes, the cooling channels could also be formed by a wave-like or box-like structure which can include metal but can also include plastic, for example, corrugated sheet or corrugated glass, and which can be arranged around the respective winding of the transformer.

Cooling channels can also be arranged in the windings of the coil in a supplementary manner, which can provide improved dissipation of the heat caused in operation in the windings of the coil, by which the heat originating in the interior of the winding of the coil can be guided to the outside and can be absorbed there by the cooling medium flowing through the cooling channels arranged in the housing and carried off.

An exemplary embodiment of the disclosure provides that the cooling medium is circulated under the influence of natural convection and flows around the electric machine.

In another exemplary embodiment of the disclosure, at least one conveying apparatus can be provided for the cooling medium, which apparatus can ensure the forced circulation of cooling medium for flowing around the electric machine and for absorbing its heat.

In accordance with an exemplary embodiment of the disclosure, at least one fan can be provided as a conveying device for the cooling medium. It is desirable that the at least one fan is arranged on the upper side of the housing accommodating the electric machine with the cooling system. This can offer an advantage that a fan arranged here can discharge, in a controlled manner the heat originating from the transformer which will arrive and accumulate here.

The cooling system, in accordance with an exemplary embodiment of the disclosure can have at least one fan arranged on the side of the housing accommodating the electric machine with the cooling system.

At least one fan can also be arranged on the bottom side of the housing accommodating the electric machine with the cooling system.

In an exemplary embodiment of the disclosure the cooling system can include at least one structure, for example, to a plate-like heat exchanger and ensures sufficient internal circulation and external circulation of the cooling medium.

A heat transfer geometry can be created by the vertically attached cooling pipes or by the corrugated structure which can be similar, for example, to the geometry of a plate-like heat exchanger. Both an interior (outside of the cooling channels) and an external circulation of the air (within the cooling channels) can be achieved around the housing. This circulation of the air can be forced or occur by natural flow.

A modular configuration can be enabled by the arrangement of the electric machine, the at least one conveying device for the cooling medium, and the at least one structure in the ambient common housing, for example, a plate-like heat exchanger.

An exemplary embodiment can be regarded as having an internal and external cooling circuit. The internal cooling circuit can include the region around the windings of the coil, which is screened against the external area on the side, for example, by a flow barrier. Within this region, which can be delimited by the flow barriers, the cooling medium can be conveyed upwardly and downwardly where it comes into direct contact with the cooling medium of the external region and transfers the heat to the same.

The external region of the cooling circuit can include the region which is delimited by the outside wall of the housing and the flow barriers as well as the heat exchangers provided in accordance with the disclosure in the roof area and on the side and optionally in the base region.

In an exemplary embodiment according to the disclosure, in the arrangement formed by the electric machine, the at least one conveying device for the cooling medium and the at least one plate-like heat exchanger, the cooling system can be expanded in a modular manner in the surrounding housing. For this purpose, the individual components can be arranged as modules whose dimensions can be adjusted relative to one another in such a way that a simple change can occur easily and without too much work.

Fans can be provided for the purpose of forced cooling which, can be attached to the bottom, the side and the upper region of the housing. Fans can be arranged as axial fans and can be attached in a modular manner to the roof, with a respective roof construction or a structure used for the attachment being optionally provided.

The cooling of hot points, for example, the roof, can be improved in this way because the roof fans will continue to draw in cooling air from the ambient environment at the transformer housing base at the so-called "cooling medium inlet." Cooling air can be ejected upwardly. Furthermore, fans, such as radial fans, can be attached laterally to the housing. They can ensure that the heated air is drawn in at the upper edge of the coil and is guided back between the cooling pipes or the corrugated structure and a vertical air-guide plate. The lateral fans can also be mounted in a structure in order to ensure modularity of the concept.

FIG. 1 shows a schematic view of a three-phase power transformer 10 according to an exemplary embodiment of the disclosure in a sectional view of the front side of the transformer 12, including upper yoke 14 and bottom yoke 16 and the housing 18 which surrounds the same, with the section occurring transversely through the housing 18 accommodating transformer 12 directly behind the face-side housing wall.

This sectional view shows the cooling device 20 in accordance with the disclosure for the transformer 12. The cooling device 20 can include two conveying devices for the cooling medium which are shown in this illustration and can be arranged laterally on the side walls 22 off the housing 20, and also cooling channels 24, 26, 28 on both sides of the windings 19. The cooling channels can be screened from one another by a flow guide plate 30 which can cover the entire height of the winding 19 and exposes a gap 34 to the top and the bottom through which the cooling medium circulates.

Air can be provided in the example shown here as a cooling medium, which flows around the transformer 12 emitting the heat in housing 18 and absorbing its heat in this process and conveying it to a heat sink.

The conveying devices for the cooling medium which are arranged on the side walls 22 of the housing 18 can be a part of the cooling device 20 and can be arranged as radial fans which downwardly convey the cooling medium into the first cooling channels 24 arranged between the outside wall 22 of the housing 18 and a flow guide plate 30. The cooling flow mixes there with the cooling medium which flows in through openings 32 close to the floor and flows upwardly again through second flow channels 26 which can also be arranged between the outside wall 22 and the flow guide plate 30.

Figure 4:
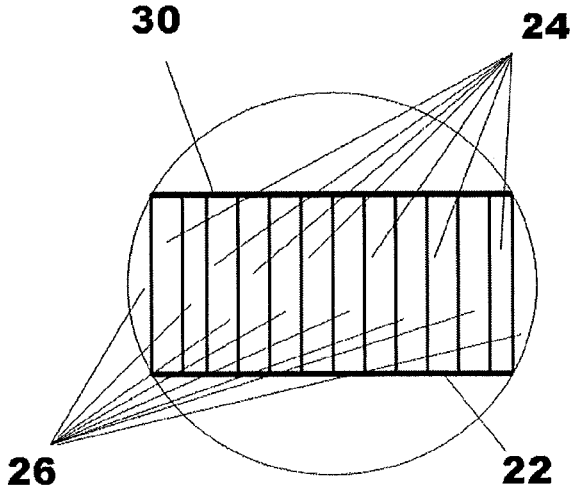
FIG. 4 shows a sectional enlargement of the detail "X" in FIG. 3.

As is shown especially in the detailed enlargement of the detail "X" in FIG. 4, the first and second cooling channels 24 and 26 can be arranged in an alternating fashion next to one another, thus providing an even temperature profile as a heat sink for the cooling of the electric machine 10 along the longitudinal side of the respective electric machine 10.

In addition, cooling medium reaches a space through a gap 34 laterally adjacent to the bottom yoke 16 on the floor of housing 18. The cooling flow is upwardly reflected from there and flows upwardly again in a further cooling channel 28 which is separated from the cooling channels 24, 26 by the flow guide plate 30.

This upward flow of the cooling medium can be supported by at least one further fan which belongs to the cooling device 20, is not shown here, and can be arranged in the roof part 36 of housing 18 and discharges the now heated cooling medium upwardly to the outside (arrows).

Figure 2:
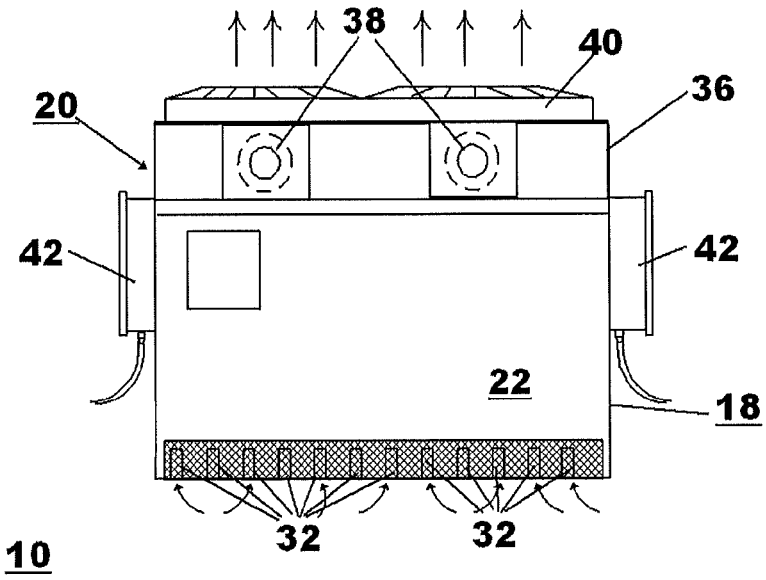
FIG. 2 shows a side view of the transformer according to FIG. 1.

FIG. 2 shows a side view of the transformer 10 which is shown in FIG. 1 and is arranged jointly with the cooling device 20 in a housing 18. The cooling device can include, in addition to the conveying devices 24 as shown in FIG. 1 and the inlet openings 32 for the cooling medium and the first and second cooling channels 26, 28, further conveying devices 38 for the cooling medium which can also be arranged in the roof region 36 of the transformer 10 in accordance with the disclosure. The conveying devices 38 are indicated here in the side view, and plate-type heat exchangers 40 which can provide cooling by discharging the waste heat.

Connection boxes 42 for the electric connection of the transformer 10 can be arranged on both front sides of the housing 18.

Figure 3:
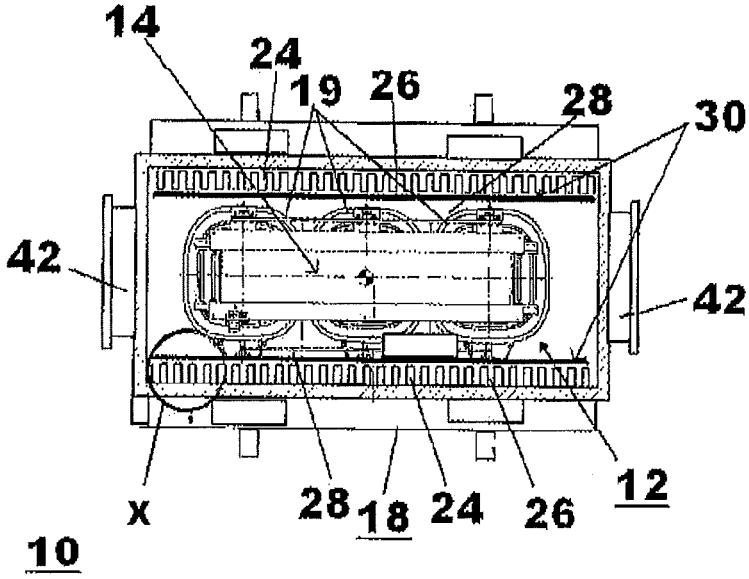
FIG. 3 shows a top view of the transformer according to FIG. 1.

FIG. 3 shows a sectional top view of transformer 10, which illustration shows the transformer 12 and the housing 18 which surrounds the same and includes the cooling channels 24, 26, 28 which are arranged therein. For this purpose, the roof region 36 of the transformer 10 has been removed.

The first and second cooling channels 24, 26 which can be arranged next to one another on both sides of the three windings 19 of transformer 12 in an axial parallel manner in relation to its longitudinal axis include individually formed channels of rectangular cross-section. They can be shaped in a box-like manner from a respectively profiled flat material, desirably light metal due to the good thermal conductivity, or also a plastic profile, with the flow guide profile 30 being provided on both sides of the windings resting directly on the same. The flow guide profile 30 separate the first and second cooling channels 24, 26 from the further cooling channels 28.

The detailed enlargement of the detail "X" as shown in FIG. 4 shows that the first and second cooling channels 24 and 26 can be arranged in an alternating manner next to one another, thus resulting in an even temperature profile as a heat sink for the cooling of the electric machine 10 along the longitudinal side of the respective electric machine 10.

These first and second cooling channels 26, 27 can be formed by a respectively shaped box-type profile which is inserted evenly into the space delimited by the outside wall 22 and the cooling guide plate 30.

The cooling concept according to an exemplary embodiment of the disclosure can be a two-circuit system, including an inner circuit in which an air flow is supported by a radial fan 38, for example. In this process, the cooling medium flows between the aforementioned cooling channels formed, for example, by the corrugated or box-type profile and between the housing wall and the flow-air guide plate. Heat can be transferred in this process to the outer "circuit."

The outer cooling circuit can be based on a vertical flow of the cooling medium being generated with the support of the roof fan, for example, the axial fan 40, in that cool air is aspirated in the floor region and flows upwardly from there into the provided cooling channels. In this process, the cool air absorbs the heat originating from the inner cooling circuit and emits it to the outside.

The coils of the transformer can be provided with inner cooling channels for use in the housing in accordance with the disclosure in order to thus better dissipate the heat losses.

Thus, it will be appreciated by those having ordinary skill in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE NUMERALS

10 Transformer
12 Transformer
14 Upper yoke
16 Bottom yoke
18 Housing
19 Winding
20 Cooling device, cooling system
22 Outside wall
24 First cooling channel
26 Second cooling channel
28 Further cooling channel
30 Flow guide profile
32 Bottom housing opening (for example, for air supply)
34 Gap region, for example for blowing out the already cooled inner air
36 Roof region
38 Conveying device, for example a radial fan
40 Plate-type heat exchanger (with conveying device, for example an axial fan)
42 Connection box 10

What is claimed is:

1. A housing for a dry-type electric machine, including a cooling system comprising:

at least one plate-type heat exchanger for defining an inner circulation area and an outer circulation area of a cooling medium;

first cooling channels provided within the housing, for conducting a flow of the cooling medium in a first direction around the electric machine; and second cooling channels for conducting a flow of the cooling medium in a second direction, opposite the first direction around the electric machine, the first cooling channels and the second cooling channels arranged in alternating order, wherein the housing accommodates the electric machine and the cooling system and forms a substantially hermetic encapsulation.

2. A housing for an electric machine according to claim 1, wherein at least a part of the first and second cooling channels for the cooling medium rest on a surface of windings of the electric machine.

3. A housing for an electric machine according to claim 1, wherein the cooling medium is gaseous.

4. A housing for an electric machine according to claim 1, wherein the cooling channels are formed by individual pipes.

5. A housing for an electric machine according to claim 1, wherein the cooling channels are formed by a corrugated structure made of metal, plastic, corrugated sheet or corrugated glass.

6. A housing for an electric machine according to claim 1, for circulating cooling medium under an influence of natural convection to flow around the electric machine.

7. A housing for an electric machine according to claim 1, comprising:

at least one conveying device for the cooling medium for causing forced circulation of the cooling medium to flow around the electric machine and absorb heat.

8. A housing for an electric machine according to claim 7, wherein at least one fan is provided as one conveying device for the cooling medium.

9. A housing for an electric machine according to claim 7, wherein the at least one conveying device for the cooling medium is provided as a fan which is arranged in a roof region of the housing accommodating the electric machine and the cooling system.

10. A housing for an electric machine according to claim 7, wherein the at least one conveying device for the cooling medium is provided as at least one fan arranged laterally on the housing accommodating the electric machine and the cooling system.

11. A housing for an electric machine according to claim 7, wherein the at least one conveying device for the cooling medium is provided as at least one fan arranged on a bottom side of the housing accommodating the electric machine and the cooling system.

12. A housing for an electric machine according to claim 11, wherein at least one second plate-type heat exchanger is arranged above windings of the electric machine.

13. A housing for an electric machine according to claim 7, wherein the housing accommodating the electric machine, the at least one conveying device for the cooling medium and the at least one plate-type heat exchanger are arranged in a modular fashion and provided as a module.

14. A housing for an electric machine according to claim 7, wherein the housing accommodating the arrangement formed by the electric machine, the at least one conveying device for the cooling medium and the at least one plate-type heat exchanger can be expanded in modular fashion.

15. A housing for an electric machine according to claim 1, wherein the electric machine is a dry-type electric power transformer.

16. A housing for an electric machine according to claim 1, wherein the first cooling channels and the second cooling channels are arranged vertically.

* * * * *